US008739405B2

(12) United States Patent
Choi et al.

(10) Patent No.: US 8,739,405 B2
(45) Date of Patent: Jun. 3, 2014

(54) METHOD OF MANUFACTURING AN EVAPORATOR FOR LOOPED HEAT PIPE

(75) Inventors: Jee Hoon Choi, Seoul (KR); Jung Hyun Yoo, Seoul (KR); Byung Ho Sung, Seoul (KR); Yun Keun Lee, Seoul (KR); Min Whan Seo, Gyeonggi-do (KR)

(73) Assignee: Zalman Tech Co., Ltd., Seoul (KR)

( * ) Notice: Subject to any disclaimer, the term of this patent is extended or adjusted under 35 U.S.C. 154(b) by 189 days.

(21) Appl. No.: 13/303,909

(22) Filed: Nov. 23, 2011

(65) Prior Publication Data

US 2013/0112375 A1 May 9, 2013

(30) Foreign Application Priority Data

Nov. 4, 2011 (KR) ..... 10-2011-0114507

(51) Int. Cl.

| | |
|---|---|
| ***B21D 53/02*** | (2006.01) |
| ***F28D 15/02*** | (2006.01) |
| ***F28D 15/04*** | (2006.01) |

(52) U.S. Cl.

USPC ..... 29/890.032; 29/890.03; 165/104.26; 165/104.33; 257/715; 257/E23.088; 361/700

(58) Field of Classification Search

USPC ..... 29/890.032, 890.03, 890.031; 165/104.26, 104.21, 104.33, 136; 361/700; 257/715, E23.088

See application file for complete search history.

(56) References Cited

U.S. PATENT DOCUMENTS

| | | | | |
|---|---|---|---|---|
| 6,803,704 | B2 * | 10/2004 | Motoi et al. | 313/103 R |
| 6,863,117 | B2 * | 3/2005 | Valenzuela | 165/104.26 |
| 7,334,630 | B2 * | 2/2008 | Goodson et al. | 165/104.33 |
| 2007/0080360 | A1 * | 4/2007 | Mirsky et al. | 257/99 |
| 2010/0065820 | A1 * | 3/2010 | Tombler, Jr. | 257/24 |
| 2010/0200199 | A1 * | 8/2010 | Habib et al. | 165/104.26 |
| 2011/0017431 | A1 * | 1/2011 | Yang et al. | 165/104.26 |
| 2012/0132534 | A1 * | 5/2012 | Das | 205/333 |

FOREIGN PATENT DOCUMENTS

| | | | |
|---|---|---|---|
| JP | 2000-14671 | A | 5/2000 |
| JP | 2011-204851 | A | 10/2011 |
| KR | 10-0671041 | B1 | 1/2007 |

OTHER PUBLICATIONS

KIPO Notice of Allowance dated Dec. 20, 2012; Appln. 10-2011-0114507.

* cited by examiner

*Primary Examiner* — Sarang Afzali
(74) *Attorney, Agent, or Firm* — Ladas & Parry LLP

(57) ABSTRACT

An evaporator for a looped heat pipe (LHP) system, in which a working fluid circulates to cool heat generating electronic components that generate heat during operation, the evaporator including: a body comprising an inlet through which the working fluid enters and an outlet through which the working fluid is discharged; a sintered wick that is included in the body, wherein the sintered wick is formed by sintering a metal powder, and a plurality of pores are formed in the sintered wick; and an additional layer that is formed on a vaporization surface of the sintered wick where evaporation of the working fluid occurs, wherein a plurality of through holes are formed in the additional layer such that the working fluid changed into a vapor state passes through the additional layer after passing the sintered wick.

4 Claims, 6 Drawing Sheets

METHOD OF MANUFACTURING AN EVAPORATOR FOR LOOPED HEAT PIPE

CROSS-REFERENCE TO RELATED PATENT APPLICATION

This application claims the benefit of Korean Patent Application No. 10-2011-0114507, filed on Nov. 4, 2011, in the Korean Intellectual Property Office, the disclosure of which is incorporated herein in its entirety by reference.

BACKGROUND OF THE INVENTION

1. Field of the Invention

The present invention relates to an evaporator that forms a looped heat pipe system with a condenser, a vapor transport line, and a liquid transport line, and a method of manufacturing the evaporator, and more particularly, to an evaporator for a looped heat pipe system, including an additional layer, in which a plurality of through hole pores are formed, and that is formed on an vaporization surface of a sintered wick inside the evaporator, so that a working fluid may flow a relatively long distance and under a relatively high heat flux condition.

2. Description of the Related Art

Electronic components such as a central processing unit (CPU) or a semiconductor chip, used in various electronic devices such as computers generate a lot of heat during operation. The electronic components are designed to perform their functions usually at room temperature, and thus if the heat generated during operation is not effectively dissipated, not only is performance of the electronic components degraded but the electronic devices are damaged in some circumstances.

Examples of methods of cooling electronic components may be a thermal conduction method using a heat sink, a method using natural air convection and radiation, a forced convection method using a fan, a method using liquid circulation, and a submerged cooling method.

However, as electronic products are reduced in size to be slim, installation intervals between electronic components thereof that generate heat during operation are continuously reduced, and thus, currently, the heat generated during use of the electronic products is not properly dissipated. Also, due to the high integration degree and high performance of the electronic components, a heat generation load of the electronic components is continuously increasing, and thus it is difficult to cool the electronic components using the above-described conventional cooling methods.

As a new technology for solving this problem, a phase change heat transport system capable of cooling electronic components having a highly thermal density has been introduced. One example of the phase change heat transport system is a cylindrical heat pipe.

As illustrated in FIG. 1, a typical cylindrical heat pipe 100 is used to perform cooling as a working fluid is circulated using a capillary pumping force of a sintered wick 102 installed on an inner wall of the cylindrical heat pipe 100.

Upon receiving heat from a heat source 101, the working fluid contained in the sintered wick 102 is evaporated and is transferred along an arrow 103 denoting a vapor flow, and then heat of the working fluid is taken away by a heat sink 104, and the working fluid is condensed again and flows through the sintered wick 102 along an arrow 105 denoting a liquid flow, by a capillary pumping force, to thereby circulate.

However, although dependence of a heat pipe on a gravity field is low, there are still limitations regarding arrangement of components; for example, if a condensation section is located below an evaporation section in a gravity field, heat transport capability of the heat pipe decreases greatly. Thus, if the heat pipe is applied as a cooling system in an electronic product, the heat pipe may be a restriction on a structure of the electronic product.

In addition, since a vapor and a liquid flow in opposite directions in a straight cylindrical heat pipe, the vapor and the liquid mix in a middle portion of the pipe. Through the mixture, an amount of heat to be transferred is substantially reduced compared to a heat amount that can be transferred theoretically.

A looped heat pipe (LHP) system is suggested as an ideal heat transfer system to solve the problems due to the structure restriction and the mixing of a vapor and a liquid.

An LHP system is a type of capillary pumped loop heat pipe (CPL) developed by NASA of the US in order to dissipate large amounts of heat generated in communication devices or electronic devices for artificial satellites.

FIG. 2 is a schematic conceptual diagram of a conventional LHP system 110. The conventional LHP system 110 includes a condenser 112, an evaporator 114, and a vapor line 116 and a liquid line 118 that connect the condenser 112 and the evaporator 114 to one another to thereby form a loop.

FIG. 3 is a schematic conceptual diagram illustrating an operation of the LHP system 110 of FIG. 2.

The evaporator 114 includes a compensation chamber 112 that accommodates a working fluid that is to be liquefied before permeating into a sintered wick 120 included in the evaporator 114, to buffer the working fluid. In the LHP system 110, the sintered wick 120 is installed only in the evaporator 114, unlike the conventional straight heat pipe 100 (see FIG. 1).

The LHP system 110 having the above-described structure operates according to the following principle.

First, when a heating plate 124 of the evaporator 114 contacting a heat source such as a heat generating component is heated, a working fluid permeated into the sintered wick 120 is heated to a saturation temperature by heat transmitted from the heating plate 124, and is changed into a vapor.

The generated vapor is transferred to the condenser 112 along a vapor line 116 connected to a side of the evaporator 114. Next, as the vapor passes through the condenser 112 and dissipates heat to the outside, the vapor is condensed, and the condensed working fluid is moved to the evaporator 114 again along a liquid line 118 connected to the condenser 112, thereby repeating the above-described operation to cool the heat source 101.

As illustrated in FIG. 3, the sintered wick 120 is bonded to an inner circumferential surface of the evaporator 114, and a space formed by the inner circumferential surface of the sintered wick 120 forms a vapor passage through which the working fluid is changed into a vapor and moves to the vapor line 116.

Meanwhile, the working fluid in a liquid state is changed into a vapor on a surface of the sintered wick 120. Accordingly, this surface is referred to as an evaporation interface or a vapor-liquid interface.

The working fluid circulates while passing by points denoted by P1 through P7. The working fluid is evaporated at the point P1, and the evaporated working fluid moves to the point P2 through the vapor path inside the evaporator 114, and then moves to the point P3 along the vapor line 116. By passing from the points P3 and P4 at an inlet to the point P5 at an outlet of the condenser 112, the working fluid in a vapor state is condensed again. The working fluid in a liquid state passes by the point P6 at the inlet of the evaporator 114 along the liquid line 118 and passes a compensation chamber 122 and is absorbed by the sintered wick 120 at the point P7 to move to the point P1 again.

Meanwhile, in the LHP system 110, a force that causes movement of the working fluid is a capillary pumping force of the sintered wick 120. The capillary pumping force is related to a diameter of pores formed in the sintered wick 120.

That is, if the diameter of pores formed in the sintered wick 120 is reduced, a capillary pumping force is increased. However, at the same time, as the size of pores is reduced, permeability of the sintered wick 120 decreases. Thus, it is difficult to obtain desired cooling performance just by adjusting a size of pores in the sintered wick 120.

Consequently, a sintered wick included in an evaporator used in an LHP system needs to be configured such that a capillary pumping force is increased but permeability is not decreased, so that a working fluid may be effectively circulated.

SUMMARY OF THE INVENTION

The present invention provides an evaporator for a looped heat pipe (LHP) system, in which a capillary pumping force is increased but permeability is not decreased so as to facilitate circulation of a working fluid inside the LHP system, thereby improving cooling efficiency for relatively long distance transportation and under a relatively high heat flux condition.

The present invention also provides a method of manufacturing the evaporator for an LHP system.

According to an aspect of the present invention, there is provided an evaporator for a looped heat pipe (LHP) system, in which a working fluid circulates to cool a heat generating component that generates heat during operation, the evaporator comprising: a body comprising an inlet through which the working fluid enters and an outlet through which the working fluid is discharged; a sintered wick that is included in the body, wherein the sintered wick is formed by sintering a metal powder, and a plurality of pores are formed in the sintered wick; and an additional layer that is formed on an evaporation surface of the sintered wick where evaporation of the working fluid occurs, wherein a plurality of through holes are formed in the additional layer such that the working fluid changed into a vapor state passes through the additional layer after passing the sintered wick.

The sintered wick may be formed of copper, and the additional layer may be formed of alumina.

A thickness of the additional layer may be about 0.01 to about 100 μm.

A shape of the through holes formed in the additional layer may be substantially cylindrical.

A diameter of the plurality of pores formed in the sintered wick may be about 100 to about 200 μm, and a diameter of the through holes formed in the additional layer may be about 10 to about 500 μm.

A thickness of the additional layer may be about 0.01 to about 100 μm, and a diameter of the through holes formed in the additional layer may be about 20 to about 200 nm.

According to another aspect of the present invention, there is provided a method of manufacturing an evaporator for a looped heat pipe (LHP) system, in which a working fluid circulates to cool a heat generating component that generates heat during operation, the evaporator comprising: a body comprising an inlet through which the working fluid enters and an outlet through which the working fluid is discharged; a sintered wick that is included in the body, wherein the sintered wick is formed by sintering a metal powder, and a plurality of pores are formed in the sintered wick; and an additional layer that is formed on an vaporization surface of the sintered wick where evaporation of the working fluid occurs, wherein a plurality of through holes are formed in the additional layer such that the working fluid changed into a vapor state passes through the additional layer after passing through the sintered wick, wherein the additional layer included in the sintered wick is formed by: preparing the sintered wick and a thin film that is formed of a metal and has a small thickness; bonding the thin film to the vaporization surface of the sintered wick; and anodizing the thin film to form the through holes in the thin film.

The sintered wick may be formed of copper, and the thin film may be formed of aluminum, and after the anodizing is performed, the thin film may be formed of alumina.

The thin film may comprise a heat pressing operation in which the thin film is contacted to the vaporization surface of the sintered wick and heat and pressure are applied to couple the thin film with the vaporization surface of the sintered wick to each other.

A thickness of the thin film may be about 10 μm to about 500 μm, and after the bonding the thin film, an electrochemical polishing operation may be further performed to the thin film.

After the electrochemical polishing operation is performed, the thickness of the thin film may be reduced to about 0.01 μm to about 10 μm.

A shape of the through holes formed after the anodizing is performed may be substantially cylindrical, and a diameter of the through holes is about 10 to about 500 nm.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

The present invention relates to an evaporator that is one of various elements of a looped heat pipe (LHP) system.

Figure 1:
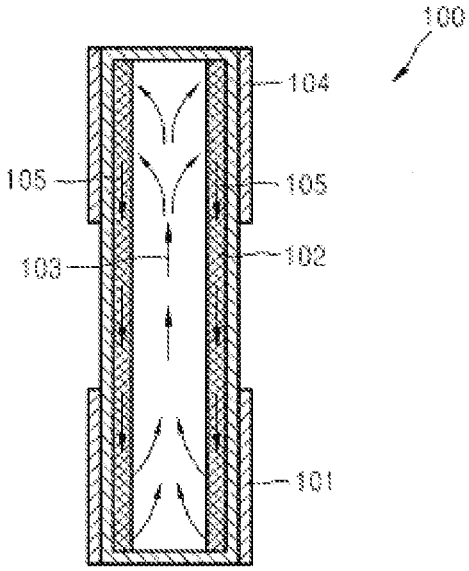
FIG. 1 (Prior Art)
FIG. 1 is a schematic view illustrating an operation of a conventional cylindrical heat pipe.
Figure 2:
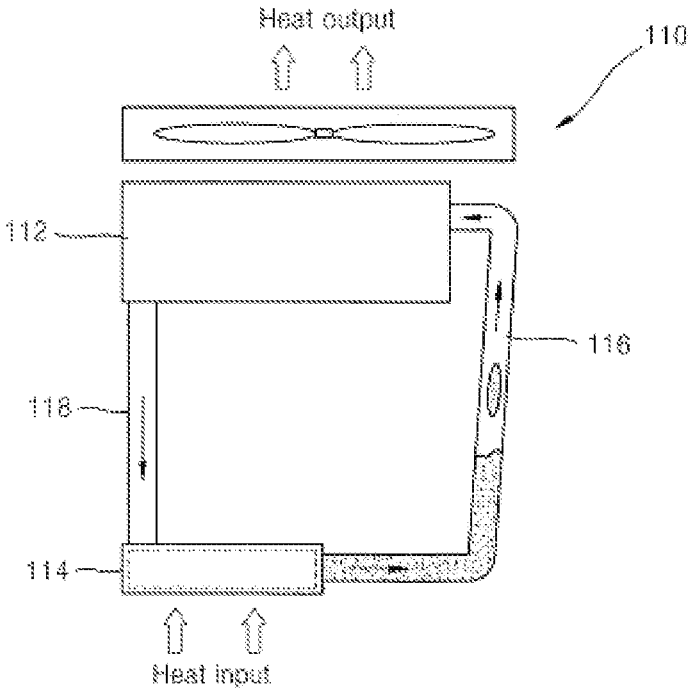
FIG. 2 (Prior Art)
FIG. 2 is a conceptual diagram illustrating a conventional looped heat pipe (LHP) system.
Figure 3:
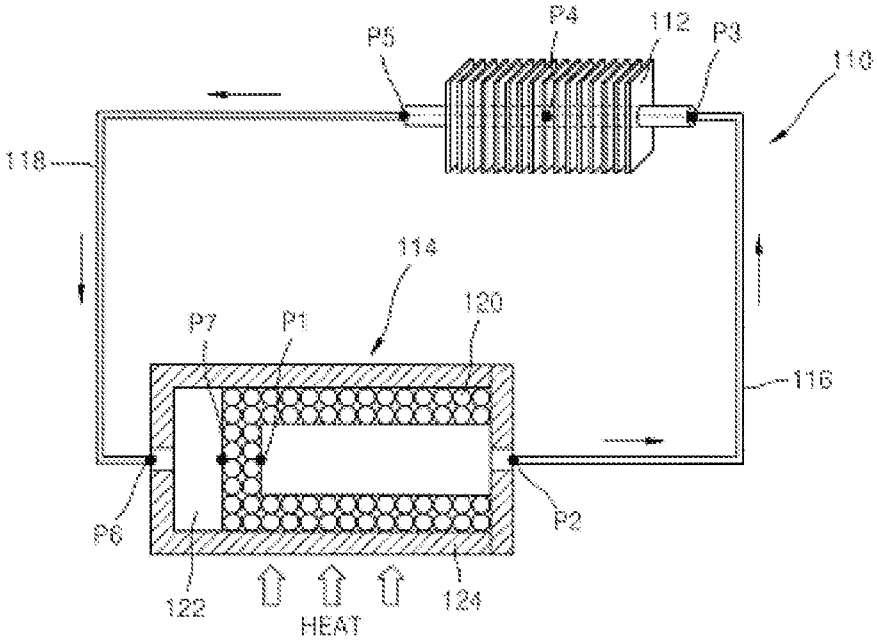
FIG. 3 (Prior Art)
FIG. 3 is a conceptual diagram for explaining an operation of the conventional LHP system of FIG. 2.
Figure 4:
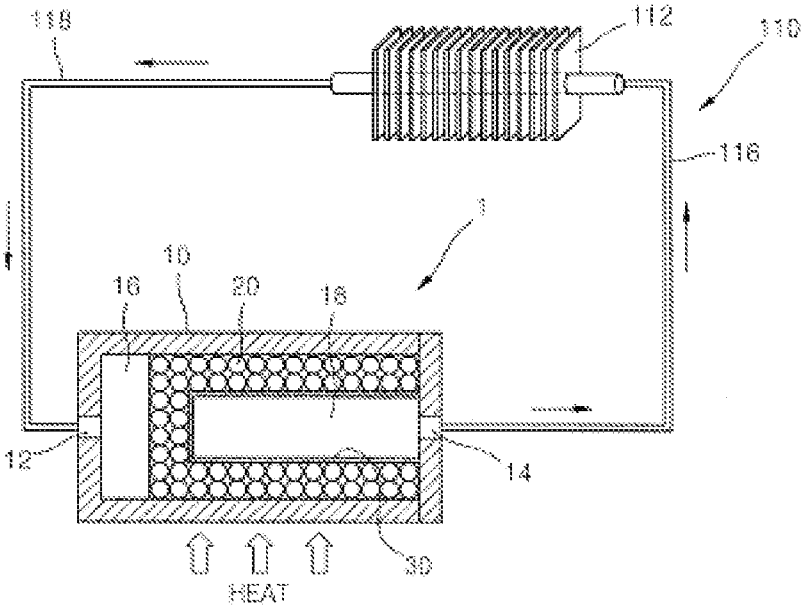
FIG. 4 is a conceptual diagram illustrating an LHP system in which an evaporator according to an embodiment of the present invention is included.

FIG. 4 is a conceptual diagram illustrating an LHP system 200 in which an evaporator according to an embodiment of the present invention is included.

Referring to FIG. 4, the LHP system 200 includes an evaporator 1 according to an embodiment of the present invention, a condenser 112, a vapor transport line 116, and a liquid transport line 118.

The condenser 112 changes a working fluid in a vapor state and transmitted from the evaporator 1 into a liquid. The condenser 112 takes heat from the working fluid to dissipate the heat to outer air.

Also, the vapor transport line 116 is a line member that connects the evaporator 1 and the condenser 112 so that the working fluid changed into a vapor state in the evaporator 1 may be transported to the condenser 112. The liquid transport line 118 is a line member that connects the condenser 112 and the evaporator 1 so that the working fluid changed into a liquid state in the condenser 112 may be supplied to the evaporator 1 again.

Meanwhile, the general description and operations as described in the related art of the invention apply to the condenser 112, the vapor transport line 116, and the liquid transport line 118.

Hereinafter, the evaporator 1 for an LHP system according to the current embodiment of the present invention will be described in detail with reference to FIGS. 4 through 8.

Figure 5:
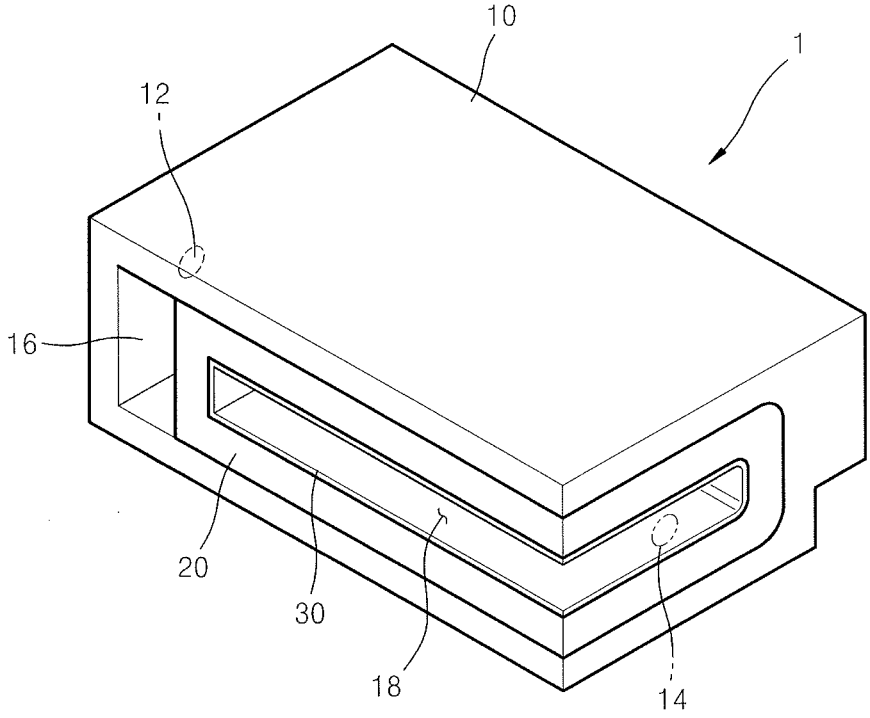
FIG. 5 is a partial perspective view of the evaporator of FIG. 4 according to an embodiment of the present invention.
Figure 6:
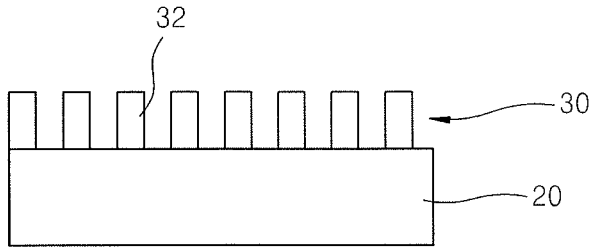
FIG. 6 is a schematic expanded cross-sectional view illustrating a portion of an additional layer included on a sintered wick illustrated in FIG. 5.
Figure 7:
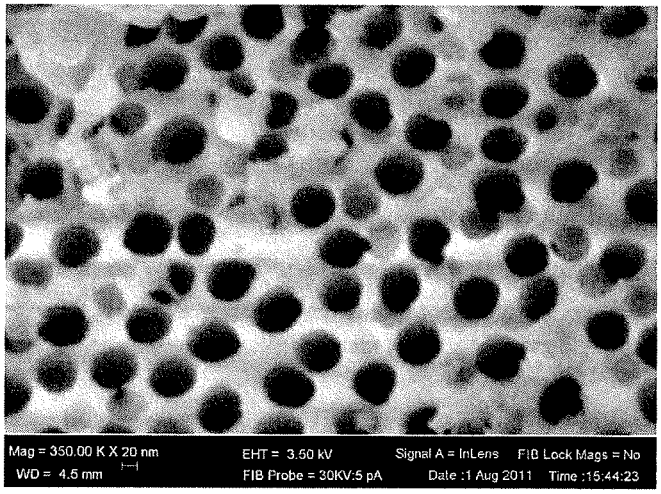
FIGS. 7 and 8 are photographic images of the additional layer illustrated in FIG. 5 photographed using a scanning electronic microscope (SEM) at different magnifications.
Figure 8:
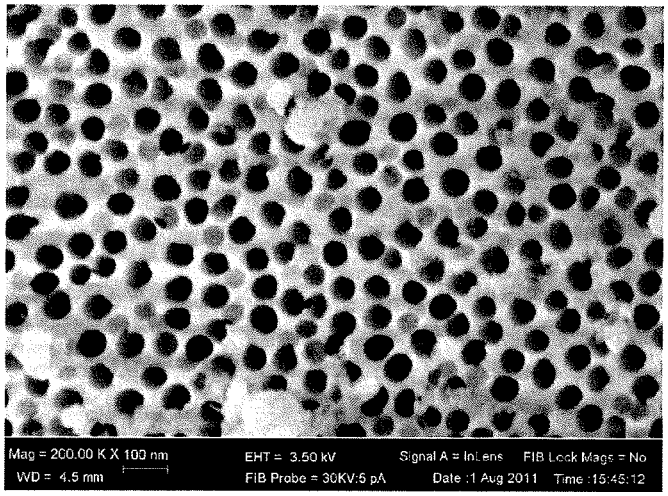
Figure 9:
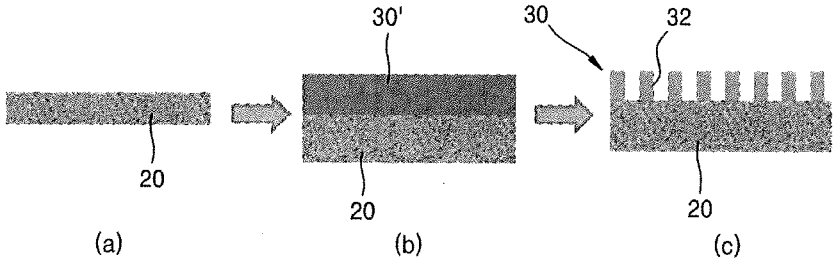
FIGS. 9A through 9C are conceptual diagrams for explaining a method of manufacturing an evaporator for an LHP system according to an embodiment of the present invention.

FIG. 4 is a conceptual diagram illustrating the LHP system 200 in which the evaporator 1 according to the current embodiment of the present invention is included. FIG. 5 is a partial perspective view of the evaporator 1 of FIG. 4. FIG. 6 is a schematic expanded cross-sectional view illustrating a portion of an additional layer included in a sintered wick of FIG. 5. FIGS. 7 and 8 are photographic images of an additional layer 30 illustrated in FIG. 5 captured using a scanning electronic microscope (SEM) at different magnifications.

The evaporator 1 for an LHP system according to the current embodiment of the present invention includes a body 10, a sintered wick 20, and an additional layer 30.

The body 10 is in contact with a heat generating electronic component (not shown) to receive heat generated during operation of the heat generating electronic component (see "heat" and arrows indicating the same shown in FIG. 4). The body 10 is formed of a metal having a relatively high thermal conductivity, for example, copper or aluminum. Meanwhile, the body 10 may be formed to contact a heat generating component at a portion of an outer surface of the body 10.

Inside the body 10, a compensation chamber 16 and the sintered wick 20 including the additional layer 30 are formed. An inlet 12 and an outlet 14 are formed in the body 10. According to the current embodiment, the compensation chamber 16 is formed at the inlet 12 of the body 10.

A working fluid that circulates through the LHP system 200 flows into the body 10 in a liquid state through the inlet 12. The working fluid in a liquid state is contained in the compensation chamber 16 before moving to the sintered wick 20.

Through the outlet 14, the working fluid in a vapor state is discharged out of the body 10. That is, the working fluid is changed into a vapor by passing through the sintered wick 20 and the additional layer 30, and is discharged out of the body 10 after passing a vapor removal space 18 surrounded by the additional layer 30. The discharged working fluid is moved to the condenser 112 via the vapor transport line 116.

The sintered wick 20 is contained in the body 10. The sintered wick 20 is formed by sintering a metal powder such as a copper or aluminum powder. The sintered wick 20 is a porous material in which a large number of pores are formed. The sintered wick 20 may be manufactured using a generally known method.

Meanwhile, according to the current embodiment of the present invention, the pores formed in the sintered wick 20 may be formed using a general method of forming a sintered wick using a copper powder, and such that a diameter of the pores is in a range from about 100 to about 200 μm.

As the working fluid in a liquid state flows into the sintered wick 20, the pores having a diameter in the above-described range allow good permeability of the working fluid. However, the pore size may be adjusted according to the type of working fluid used in the LHP system 200.

The specific shape of the sintered wick 20 may be modified variously as long as the working fluid flown through the inlet 12 satisfies a predetermined condition of being discharged from the outlet 14 after passing the sintered wick 20.

The additional layer 30 is included in the sintered wick 20. In particular, the additional layer 30 is formed on a vaporization surface of the sintered wick 20 where evaporation of the working fluid occurs. However, the vaporization surface does not necessarily refer to a surface on which evaporation occurs. Referring to FIG. 5, if assuming that no additional layer is included, any surface of the sintered wick 20 exposed to the vapor removal space 18 connected in line with the outlet 14 may be referred to as a vaporization surface.

Meanwhile, as the shape of the sintered wick 20 is modified variously, the shape of the vaporization surface of the sintered wick 20 is also modified variously, and thus the specific shape of the additional layer 30 is also modified accordingly.

Referring to FIG. 6, a plurality of through holes 32 are formed in the additional layer 30. The working fluid changed into a vapor state after passing the sintered wick 20 may pass through the through holes 32.

According to the current embodiment of the present invention, the additional layer 30 is formed of alumina formed by oxidizing aluminum. Also, a thickness of the additional layer 30 may preferably be as thin as possible to reduce contact heat resistance between the sintered wick 20 and the additional layer 30 and to improve a capillary pumping force on the working fluid.

According to the current embodiment, the thickness of the additional layer 30 may preferably be in a range of about 0.01 to about 100 μm. Also, more preferably, the thickness of the additional layer 30 may be in a range of about 0.01 to about 10 μm. If the thickness of the additional layer 30 is less than about 0.01 μm, it is difficult to actually form the additional layer 30. If the thickness of the additional layer 30 is greater than 100 μm, permeability of the working fluid is decreased due to flow resistance of the working fluid and low heat resistance of the additional layer 30.

The through holes 32 may preferably be formed over the entire surface of the additional layer 30.

According to the current embodiment, the shape of the through holes 32 is substantially cylindrical. "Substantially cylindrical" means that it is satisfactory when the overall shape of the through holes 32 is cylindrical or similar to a cylindrical shape, and it does not only mean a shape that conforms to a mathematical definition.

Meanwhile, according to another embodiment of the present invention, as long as through holes are passed through, the shape of through holes may be not only cylindrical but be modified to have a polygonal shape or a pillar shape that is slightly bent in a length direction.

A diameter of the through holes 32 may preferably be in a range from about 10 nm to about 500 nm so as to improve a capillary pumping force. Also, the diameter of the through holes 32 may preferably be in a range of about 20 to about 200 nm. If the diameter of the through holes 32 is less than about 10 nm, it is difficult to actually form the through holes 32, and if the diameter of the through holes 32 is greater than about 500 nm, it is difficult to obtain a desired capillary pumping force.

FIGS. 7 and 8 are photographic images of the additional layer 30 photographed using a SEM at different magnifications.

Referring to the photographic images of FIGS. 7 and 8, the plurality of through holes 32 having a cylindrical shape or a shape similar to a cylindrical shape are formed over the entire surface of the additional layer 30. Considering the magnifications marked on the photographic images, a size of each through holes 32 is approximately 20 nm.

Hereinafter, function and effects of the evaporator 1 of the LHP system 200 having the above-described structure will be described in detail.

The evaporator 1 for the LHP system 200 includes the additional layer 30, in which the plurality of nano-scale through holes 32, are formed and which is formed on the vaporization surface of the sintered wick 20. Accordingly, a capillary pumping force may be improved, but permeability of the working fluid may not decrease.

An operation of the LHP system 200 including the evaporator 1 according to the current embodiment of the present invention will be briefly described with reference to FIG. 4.

A surface of the body 10 of the evaporator 1 is contacted to a heat generating electronic component (not shown). Heat generated by the heat generating electronic component is transmitted to the sintered wick 20 included in the body 10. The working fluid permeated into the sintered wick 20 is changed into a vapor state by the transferred heat.

The working fluid changed into a vapor state is discharged through the outlet 14. The discharged working fluid is moved to the condenser 112 to be changed into a liquid state as heat is taken away from the working fluid, and then the working fluid flows along the liquid transport line 118 and through the inlet 12 of the body 10 and into the compensation chamber 16 of the body 10.

The working fluid in a liquid state flown into the compensation chamber 16 permeates between the pores of the sintered wick 20 due to a capillary pumping force due to the pores of the sintered wick 20. The working fluid in a liquid state and permeated between the pores of the sintered wick 20 permeates between the through holes 32 of the additional layer 30 by a relatively intense capillary pumping force of the through holes 32 of the additional layer 30, and is heated by heat that is transferred from the heat generating electronic component to be changed into a vapor state, and moves to the vapor removal space 18. The working fluid circulates in this way, thereby cooling the heat generating electronic component.

Here, a capillary pumping force, which is generally referred to as "capillary pressure", is given by the following equation.

$$P = \frac{2\sigma}{r}$$

P denotes a capillary pressure, σ denotes a surface tension of the working fluid, and r denotes an effective radius of the pores of the sintered wick 20 sintered by metal particles such as copper and aluminum. Since the surface tension of the working fluid is constant, a capillary pumping force is inversely proportional to the effective radius of the pores of the sintered wick 20 sintered by metal particles such as copper and aluminum. That is, the smaller the effective radius of the pores, the greater the capillary pumping force.

Meanwhile, permeability of the working fluid is proportional to the effective radius of the pores. That is, the smaller the effective radius of the pores, the smaller the permeability.

Like general sintered wicks, the sintered wick 20 according to the current embodiment of the present invention also has micro-scale pores, and the additional layer 30 including the through holes 32, which are a plurality of nano-scale through holes, is formed on the vaporization surface of the sintered wick 20 so as to improve a capillary pumping force and permeability of the working fluid. Consequently, the working fluid may be easily circulated, thereby improving cooling performance.

That is, the working fluid in a liquid state may have no difficulty in passing through the sintered wick 20 in which micro-scale pores are formed. In addition, due to the nano-scale through holes 32 formed in the additional layer 30, a capillary pumping force is improved, thereby facilitating circulation of the working fluid. Here, the working fluid passing through the through holes 32 is in a vapor state, and thus no problem occurs in regard to permeability.

Hereinafter, a method of manufacturing an evaporator for an LHP system according to another embodiment of the present invention will be described.

According to the method of manufacturing an evaporator for an LHP system according to the current embodiment of the present invention, an evaporator that is an element of an LHP system, in which a working fluid circulates to cool a heat generating component heated during operation, is manufactured.

The method of manufacturing an evaporator for an LHP system according to the current embodiment of the present invention will be described with reference to FIGS. 4 through 12 below.

An evaporator 1 manufactured according to the method of manufacturing an evaporator according to the current embodiment of the present invention includes a body 10, a sintered wick 20, and an additional layer 30. Elements of the evaporator 1 are identical or similar to those of the evaporator 1 described above, and thus description thereof will not be repeated, and previous description or appropriate modification of the description will apply.

One of major features of the method of manufacturing an evaporator according to the current embodiment of the present invention is related to how the additional layer 30 is disposed on a vaporization surface of the sintered wick 20. Techniques well-known in the art may be applied to configure the elements other than the additional layer 30. Hereinafter, configurations related to the additional layer 30 will be described.

An operation of including the additional layer 30 in the sintered wick 20 comprises preparing a thin film, bonding the thin film, and anodization.

In an operation of preparing a thin film, the sintered wick 20 and a metal thin film having a small thickness are prepared. That is, referring to FIG. 9A, in this operation, the sintered wick 20 is prepared, and a thin film 30' formed of a metal is formed on a portion of the sinter wick 20 that is to be formed as the vaporization surface of the sintered wick 20. According to the current embodiment, the thin film 30' is formed of aluminum of 99% purity. The thin film 30' is usually referred to as a foil.

Here, the sintered wick 20 is formed of copper. A diameter of pores formed in the sintered wick 20 may preferably be about 100 to about 200 μm. According to the current embodiment, a thickness of the thin film 30' may preferably be about 10 to about 500 μm.

Next, an operation of bonding the thin film is performed.

In the thin film bonding operation, the metal thin film 30' is bonded to the vaporization surface of the sintered wick 20 using metallic bonding process applied by heat and pressure. According to the current embodiment, the thin film bonding operation is performed by a hot pressing operation in which the thin film 30' is contacted to the vaporization surface of the sintered wick 20 and then heat and pressure are applied thereto to bond the thin film and the vaporization surface of the sintered wick 20 to each other (refer to FIG. 9B).

Meanwhile, according to the current embodiment, an electrochemical polishing operation is further performed after the thin film bonding operation.

The electrochemical polishing operation is performed on the thin film 30' bonded to the sintered wick 20 using a hot pressing operation. Generally, an electrochemical polishing operation is a process through which a desired shape, desired measurements, and desired surface states are obtained by concentrating and restricting electrochemical dissolution (anode elution or electrolysis elution) on necessary portions of materials.

Figure 10:
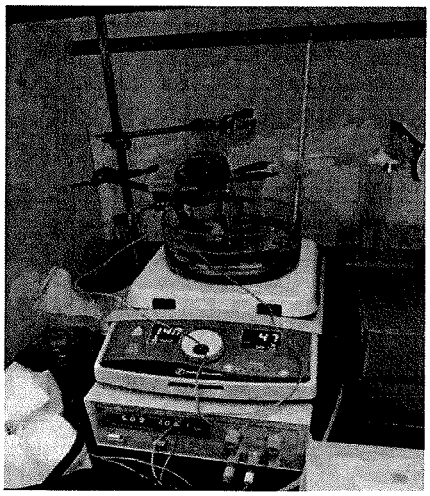
FIGS. 10 through 12 are photographic images of actual experiments related to the method of manufacturing the evaporator of FIGS. 9A through 9C.

After the electrochemical polishing operation, the thickness of the thin film 30' is reduced to be in a range of about 0.01 to about 10 μm. FIG. 10 is a photographic image showing an experiment of performing electrochemical polishing.

Figure 11:
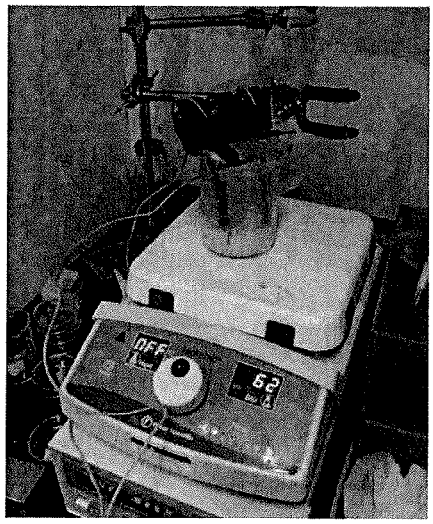

Next, anodization is performed on the thin film 30' bonded to the sintered wick 20. FIG. 11 is a photographic image showing an experiment of anodization.

In the anodization, an electrical aqueous solution is electrolyzed using a metal as a positive electrode so that a corrosion-resistant oxide thin film is formed on a metal surface. The anodization is widely used in aluminum methods.

Figure 12:
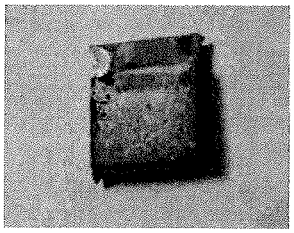

By anodizing the aluminum thin film bonded to the sintered wick 20, a large number of through holes are formed in the aluminum thin film. FIG. 9C shows a large number of through holes 32 formed in the additional layer 30 bonded to the vaporization surface of the sintered wick 20 after the anodization is performed. Also, FIG. 12 is a photographic image showing the actually sintered wick 20 including the additional layer 30 obtained through experiments as shown in FIGS. 10 and 11. A thickness of the additional layer 30 of the photographic images is about 10 μm.

Meanwhile, FIGS. 7 and 8 are photographic images of an additional layer illustrated in FIG. 12 formed of alumina, captured using a SEM. As described above, referring to the photographic images, a large number of through holes having a cylindrical shape or a shape that is similar to a cylindrical shape are formed over the entire surface of the additional layer; considering the magnification illustrated in the drawings, a size of each through hole is approximately 20 nm.

Consequently, a sintered wick including an additional layer may be manufactured according to the above-described operations, and also, an evaporator including the sintered wick including the additional layer may be manufactured. By using the evaporator in an LHP system, a capillary pumping force of sintered wick 20 may be increased but permeability of sintered wick 20 may not decrease, thereby improving cooling performance.

The evaporator for an LHP system according to the embodiments of the present invention includes a thin additional layer, in which a plurality of through pores are formed, and that is formed on a vaporization surface of a sintered wick included in the evaporator. Accordingly, a capillary pumping force of sintered wick 20 may be increased but permeability of sintered wick 20 is not decreased. Thus, a working fluid inside the LHP system is circulated smoothly, thereby improving cooling efficiency for relatively long distance transportation and under a relatively high heat flux condition.

In addition, according to the method of manufacturing an evaporator for an LHP system, the additional layer in which a plurality of through pores are formed may be easily formed on the vaporization surface of the sintered wick.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A method of manufacturing an evaporator for a looped heat pipe (LHP) system, in which a working fluid circulates to cool a heat generating electronic component that generates heat during operation, the method comprising:

forming a body comprising an inlet through which the working fluid enters and an outlet through which the working fluid is discharged;

forming a sintered wick that is included in the body, wherein the sintered wick is formed by sintering a metal powder, and a plurality of pores are formed in the sintered wick; and forming an additional layer that is formed on a vaporization surface of the sintered wick where evaporation of the working fluid occurs, wherein a plurality of through holes are formed in the additional layer such that the working fluid changed into a vapor state passes through the additional layer after passing through the sintered wick, wherein the forming of the additional layer comprises:

preparing the sintered wick and a thin film that is formed of a metal;

bonding the thin film to the vaporization surface of the sintered wick; and anodizing the thin film to form the through holes in the thin film, wherein the sintered wick is formed of copper, and the thin film is formed of aluminum, and after the anodizing is performed, the thin film is formed into alumina, wherein the bonding the thin film comprises a heat pressing operation in which the thin film is contacted to the vaporization surface of the sintered wick and heat and pressure are applied to bond the thin film and the vaporization surface of the sintered wick to each other.

2. The method of claim 1, wherein a thickness of the thin film is about 10 μm to about 500 μm, and after the bonding the thin film, an electrochemical polishing operation is further performed to the thin film.

3. The method of claim 2, wherein after the electrochemical polishing operation is performed, the thickness of the thin film is reduced to about 0.01 μm to about 10 μm.

4. The method of claim 1, wherein a shape of the through holes formed after the anodizing is performed is substantially cylindrical, and a diameter of the through holes is about 10 nm to about 500 nm.

* * * * *